US011465887B2

(12) United States Patent
Urban

(10) Patent No.: US 11,465,887 B2
(45) Date of Patent: Oct. 11, 2022

(54) SUPPORT FOR THE REAR ANCHORING LINE OF A TELESCOPIC CRANE

(71) Applicant: Tadano Demag GmbH, Zweibrücken (DE)

(72) Inventor: Christian Moritz Urban, Zweibrücken (DE)

(73) Assignee: Tadano Demag GmbH, Zweibrücken (DE)

( * ) Notice: Subject to any disclaimer, the term of this patent is extended or adjusted under 35 U.S.C. 154(b) by 120 days.

(21) Appl. No.: 17/256,964

(22) PCT Filed: Jul. 5, 2019

(86) PCT No.: PCT/EP2019/068062
§ 371 (c)(1),
(2) Date: Dec. 29, 2020

(87) PCT Pub. No.: WO2020/011657
PCT Pub. Date: Jan. 16, 2020

(65) Prior Publication Data

US 2021/0179398 A1 Jun. 17, 2021

(30) Foreign Application Priority Data

Jul. 9, 2018 (DE) ..... 102018116575.7

(51) Int. Cl.
*B66C 23/42* (2006.01)
*B66C 23/70* (2006.01)
*B66C 23/82* (2006.01)

(52) U.S. Cl.
CPC ..... *B66C 23/42* (2013.01); *B66C 23/702* (2013.01); *B66C 23/826* (2013.01); *B66C 23/823* (2013.01); *B66C 2700/0371* (2013.01)

(58) Field of Classification Search
CPC ..... B66C 23/42; B66C 23/68; B66C 23/702; B66C 23/823; B66C 2700/0371; B66C 23/826
See application file for complete search history.

(56) References Cited

U.S. PATENT DOCUMENTS

2002/0023891 A1* 2/2002 Verchere ..... B66C 23/68 212/300
2006/0096940 A1* 5/2006 Willim ..... B66C 23/826 212/300
2009/0127219 A1* 5/2009 Willim ..... B66C 23/702 212/300

FOREIGN PATENT DOCUMENTS

CN 107117542 A 9/2017
DE 1922950 A1 1/1971
DE 2258807 A1 6/1974
(Continued)

OTHER PUBLICATIONS

DE 102005049606 Machine Translation (Year: 2005).*
(Continued)

*Primary Examiner* — Michael R Mansen
*Assistant Examiner* — Juan J Campos, Jr.
(74) *Attorney, Agent, or Firm* — Gardner, Linn, Burkhart & Ondersma LLP

(57) ABSTRACT

A vehicle crane, such as a mobile crane, includes a main jib and a main jib extension that is mounted thereon and can be luffed by at least one luffing cable. The vehicle crane includes at least one anchoring support that is arranged on the main jib and guides the luffing cable in order to anchor the main jib to provided improved load-bearing capacity.

20 Claims, 4 Drawing Sheets

(56) References Cited

FOREIGN PATENT DOCUMENTS

| | | | | |
|---|---|---|---|---|
| DE | 4005082 | C1 | 9/1991 | |
| DE | 10022600 | A1 | 7/2001 | |
| DE | 20219126 | U1 | 4/2004 | |
| DE | 202005016743 | U1 | 3/2007 | |
| DE | 102005049606 | A1 * | 4/2007 | ..... B66C 23/42 |
| DE | 202014006460 | U1 | 11/2015 | |
| DE | 102016114837 | A1 | 2/2018 | |

OTHER PUBLICATIONS

International Search Report of the International Searching Authority from corresponding Patent Cooperation Treaty (PCT) Application No. PCT/EP2019/068062, indicated completed on Oct. 3, 2019.
International Written Opinion of the International Searching Authority from corresponding Patent Cooperation Treaty (PCT) Application No. PCT/EP2019/068062, indicated completed on Oct. 3, 2019.
International Preliminary Report on Patentability of the International Searching Authority from corresponding Patent Cooperation Treaty (PCT) Application No. PCT/EP2019/068062, indicated completed on Sep. 9, 2020.
Preliminary Report on Patentability of the International Searching Authority in English from corresponding Patent Cooperation Treaty (PCT) Application No. PCT/EP2019/068062, completed Sep. 9, 2020.

* cited by examiner

SUPPORT FOR THE REAR ANCHORING LINE OF A TELESCOPIC CRANE

CROSS REFERENCE TO RELATED APPLICATION

The present application claims the priority benefits of International Patent Application No. PCT/EP2019/068062, filed Jul. 5, 2019, and claims benefit of German patent application 10 2018 116 575.7, filed on Jul. 9, 2018.

BACKGROUND AND FIELD OF THE INVENTION

The invention relates to a vehicle crane, in particular a mobile crane or crawler crane, with a telescopic main jib and a guying support which can raise itself, is mounted in an articulated manner on a telescoping section and guides the luffing cable of a luffable main jib extension.

The German utility model DE 202 19 126 U1 discloses a telescoping jib of a crane which consists in the conventional manner of a basic box and a plurality of telescoping sections able to telescope out therefrom. A guying bracket with two guying supports which can be splayed in a V shape is disposed on at least one of the telescoping sections, in the head region thereof. In order to erect the guying supports from an inoperative position approximately parallel to the respective telescoping section into a guying position, in each case tie anchors are disposed between a free end of the guying supports and a head region of an adjacent telescoping section. By extension of this adjacent telescoping section the guying supports are raised into the guying position by means of the tie anchors. In order to adapt the raising of the guying supports to the planned extension path of the adjacent telescoping section, the tie anchors are designed as manually adjustable telescoping pipes. In the guying position, respective guying cables are guided over the free ends of the guying supports in the conventional manner for the guying of the telescoping jib, which cables are fastened at least to a foot of the basic box and to a head of the innermost telescoping section.

Furthermore, the German utility model DE 20 2014 006 460 U1 discloses a further guying arrangement of a telescoping jib of a crane, which likewise comprises two guying supports which can be splayed in a V shape. In order to erect these guying supports, the guying cables are used in combination with the extension movement of the adjacent telescoping section. In order to transfer the extension movement of the adjacent telescoping section to the guying supports by means of the respective guying cable, the guying cable is able to be fixed in each case in the region of the free end of the guying support as required.

Furthermore, the German patent DE 40 05 082 C1 discloses a vehicle telescopic crane with a telescopic main jib. A short lattice mast adapter is disposed on a head of the main jib and has a main jib extension luffably mounted thereon. A luffable bracket is also mounted on the lattice mast adapter and is guyed by means of a tension cable on a penultimate inner box of the main jib. A pulley block is fastened to the bracket, serves as a luffing mechanism for the main jib extension and is connected at the other end to a head of the main jib extension. The luffing cable which runs out of the pulley block is guided downwards to a luffing winch on a superstructure of the vehicle telescopic crane.

Furthermore, the German laid-open document DE 1 922 950 A already discloses a jib crane with a main jib and a main jib extension luffable thereon about a luffing axis. In the region of the luffing axis, two luffing supports are disposed, between the upper ends of which a pulley block is disposed for luffing the main jib extension. For this purpose, the luffing supports are each fixedly clamped by means of a so-called neck cable to the foot of the main jib or the head of the main jib extension. A luffing cable which runs out of the pulley block and is required in order to luff the main jib extension is not described.

The German laid-open document DE 2 258 807 A already discloses a vehicle crane with a telescopic main jib on which a foldable guying support for additional guying of the main jib is disposed. The foldable guying support can be erected by an extension movement of a final inner box of the main jib. In the German laid-open document DE 10 2016 114 837 A1, on each head of a basic box and of an inner box of a telescopic main jib, a pair of guying supports for additional guying of the main jib is rigidly disposed. The German laid-open document DE 100 22 600 A1 already discloses a further vehicle crane with a telescopic main jib with a pair of guying supports for additional guying of the main jib. The length of the guying supports can be changed in each case in order to tension the guying arrangement.

SUMMARY OF THE INVENTION

The present invention provides a vehicle crane with improved load-bearing capacity.

In accordance with an embodiment of the invention, in the case of a vehicle crane, in particular a mobile crane, with a main jib and a main jib extension mounted thereon and being luffable by means of at least one luffing cable, wherein the luffing cable, starting from a winch on the vehicle crane, is guided by means of the guying support and at least one luffing support in the region of a main jib head and is fastened at that location or is guided further as far as the main jib extension and fastened at that location, improved load-bearing capacity is achieved in that at least one guying support is disposed on the main jib in the middle region of the main jib and guides the luffing cable in order to guy the main jib. In this way, the luffing cable is supported at least in the region of the vehicle crane on the guying support and is deflected or diverted as appropriate by the guying support. By means of this guying support with the luffing cable the normal force in the guying support is introduced into the main jib and stabilises a main jib curved under loading in the sense of rectifying the curvature. In this way, the load-bearing capacity of the vehicle crane can be increased in that the individual telescoping sections are relieved of loading. This guying support advantageously cooperates with the already provided and pre-tensioned luffing cable and therefore obviates the installation of an additional guying line which would otherwise have to be mounted and pretensioned in a time-consuming manner. In order to optimise the support force, the guying support is disposed in the middle region of the main jib, i.e. outside the head and foot of the main jib.

The middle region in accordance with the invention can be specified as follows. With reference to a vehicle crane with a main jib which is designed as a telescoping jib with a jib basic box and a plurality of telescoping sections, provision is advantageously made that the at least one guying support is disposed on the main jib between the jib basic box and the innermost telescoping section, i.e. between the basic box and the head box. In a particularly advantageous manner, provision is thus made that the at least one guying support is disposed on the main jib in the region of the middle three, preferably two, particularly preferably the one middle, telescoping section(s).

For the usual case where the main jib is designed as a telescoping jib with a jib basic box and a plurality of telescoping sections and the main jib can be luffed by means of a luffing cylinder articulated on the jib basic box, the at least one guying support is disposed on the main jib between an articulation of the luffing cylinder on the jib basic box and the innermost telescoping section.

A deflection roller is advantageously mounted at a free end of the guying support, the luffing cable being guided over this deflection roller. Therefore, the supporting forces can easily be introduced from the luffing cable into the main jib and the telescoping sections can continue to be telescoped.

For the case where the luffing cable ends in the region of the at least one luffing support, guying rods to further luffing supports and to the main jib extension are used as an extension of the luffing cable in order ultimately to achieve a connection to the main jib extension to be luffed. Instead of a continuous luffing cable from the winch as far as the main jib extension, at least parts thereof can be replaced from the first luffing support in the direction of the main jib extension by guying rods, belts, chains or other flexible components with a high level of tensile strength.

Transportation and mounting of the guying support is facilitated in that the guying support is disposed on the main jib so as to pivot about a horizontal axis, and the guying support can be raised out of an inoperative position into an operating position. In this case, the at least one guying support is advantageously disposed on a head of a telescoping section of the telescoping jib.

In order to obtain clearly defined kinematics in the sense of a pivoting-back direction of the guying support under its own weight or under the deflection force arising from the deflected luffing cable, the guying support in the operating position forms an angle with respect to the main jib in the range of 75 to 85 degrees, preferably 80 degrees. An angle of 90 degrees is to be preferred for raising of the support arrangement with a hydraulic cylinder. All in all, the guying support in the operating position forms an angle with respect to the main jib in the range of 75 to 90 degrees.

Particularly easy raising of the guying support in the sense of raising itself is achieved in that the main jib is designed as a telescoping jib and the guying support can be raised by means of an extension movement of the telescoping jib out of the inoperative position into the operating position. Furthermore, under the provided guying arrangement in accordance with the invention, a telescoping jib can be extended further for comparable loads and accordingly achieves higher lifting heights.

For this purpose provision is advantageously made that the guying support can be raised by means of a raising cable which engages at the end of the guying support by means of a bracket on the guying support and is connected to a head of a telescoping section above the guying support.

With a view to safety considerations, provision is made that a safety cable defines maximum raising of the guying support and the safety cable engages at the end of the guying support and is connected to a head of a telescoping section below the guying support. The guying support is prevented from flipping upwards.

In an advantageous embodiment, provision is made that a plurality of guying supports are disposed on different heads of telescoping sections of the telescoping jib.

A guying support which is variably adjustable in length is particularly preferred. The deflection point or guide point between the guying support and the luffing cable can thereby be shifted as far away as possible from the main jib in the orthogonal direction.

An exemplified embodiment of the invention will be explained in greater detail with reference to the following description.

DESCRIPTION OF THE PREFERRED EMBODIMENTS

Figure 1:
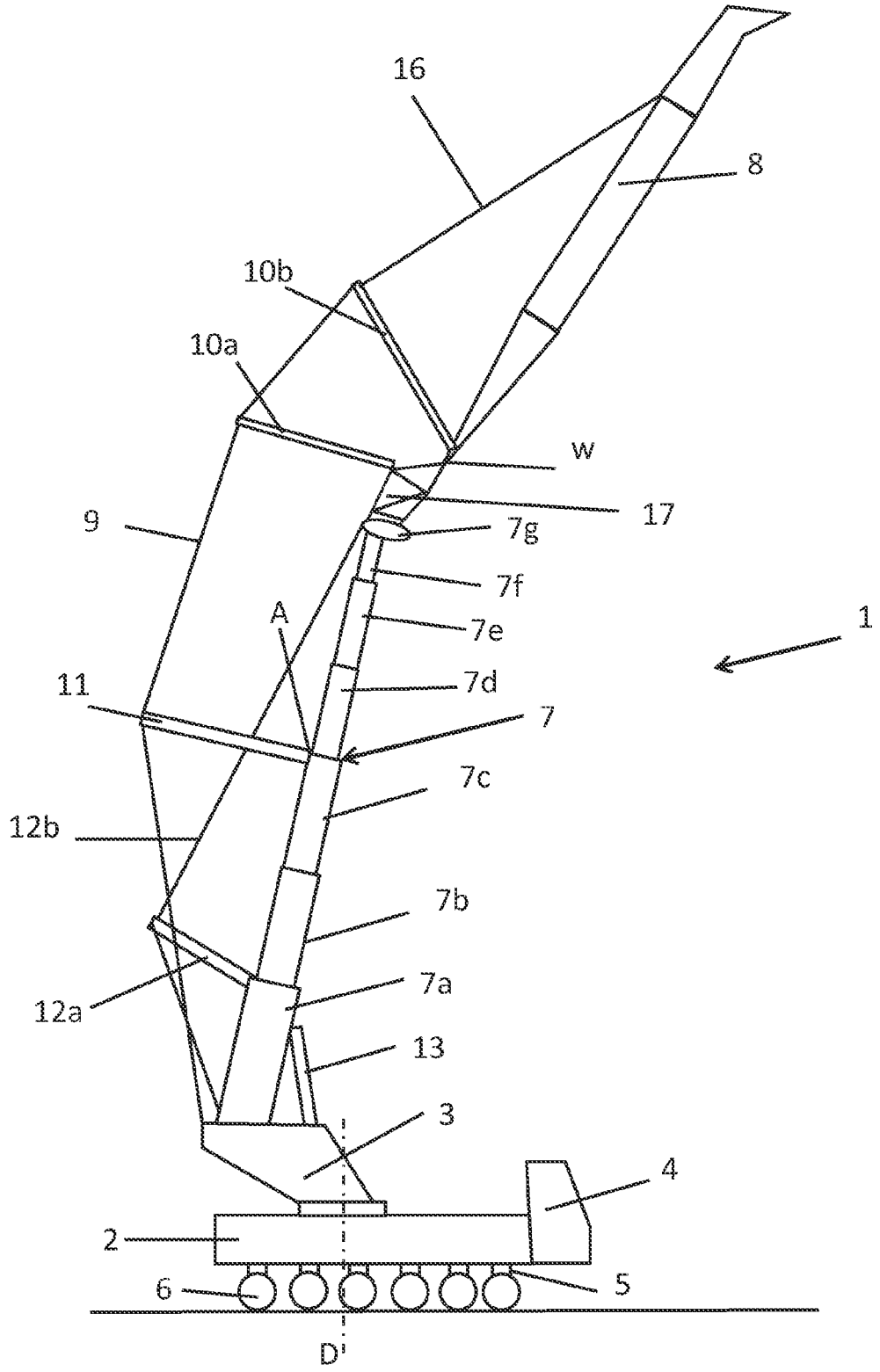
FIG. 1 shows a schematic side view of a vehicle crane with a main jib and a luffable main jib extension.

FIG. 1 is a schematic side view of a vehicle crane 1, in particular of a mobile crane, with a lower carriage 2 and a superstructure 3. The lower carriage 2 comprises a driver's cabin 4 and six axles 5 each with two rubber-tyred wheels 6 suitable for road travel. The lower carriage 2 can naturally comprise more or less than six vehicle axles 5 or alternatively comprise a crawler track. The superstructure 3 is mounted on the lower carriage 2 in such a manner as to be pivotable about a vertically orientated axis of rotation D. The superstructure 3 and lower carriage 2 can alternatively also be rigidly mounted one on another. A main jib 7 is disposed on the superstructure 3 which can pivot about the horizontal axis D, this main jib being designed as a telescoping jib. The main jib 7 comprises a jib basic box 7*a* and a plurality of telescoping sections 7*b* to 7*f* which are disposed one inside another and can telescope out. The jib basic box 7*a* is mounted on the superstructure 3 so that it can be raised by means of a luffing cylinder 8, whereby the main jib 7, after complete retraction of the telescoping sections 7*b* to 7*f* into the jib basic box 7*a* can be laid onto the lower carriage 2 for road transport.

Furthermore, at an upper end of the fifth telescoping section 7*f*, and therefore on a main jib head 7*g*, a luffable main jib extension 8, designed as a lattice mast girder, is pivotably attached and can be raised relative to the main jib 7 about a horizontal luffing axis W. In a conventional manner, the luffing axis W is orientated orthogonally to the longitudinal axis of the main jib 7. In a conventional manner, at least one luffing cable 9 is provided for the luffing process of the main jib extension 8, this cable extending from a winch, not illustrated, which is disposed in the rear region of the superstructure 3, to a first luffing support 10*a* and is fastened at that location. Further along, the function of the luffing cable 9 is taken over by guying rods 16, which in a corresponding manner are fastened between the first luffing support 10*a* and a second luffing support 10*b* and between the second luffing support 10*b* and approximately the middle of the main jib extension 8. The first luffing support 10*a* and the second luffing support 10*b* are mounted in a conventional manner in the region of the main jib head 7*g* in an articulated manner about horizontal axes and extend backwards in relation to the main jib 7 and in a V shape with respect to each other.

This at least one luffing cable 9 is additionally guyed by means of a further guying support 11 in accordance with the invention in the region of the main jib 7. In the present case, the guying support 11 is disposed approximately in the middle of the main jib 7 so as to be pivotable about a horizontal axis A and therefore in an articulated manner. The guying support 11 can fundamentally be disposed between the articulation of the luffing cylinder 8 on the main jib 7 and the main jib head 7*g*. In terms of relieving the load on the main jib 7 a middle region will certainly ultimately result when considered statically. In addition to the illustrated single guying support 11, two or more guying supports 11 can also be disposed spaced apart along the rear side of the main jib 7.

In addition, a further auxiliary guying support 12*a* is fastened to the head or the upper end of the jib basic box 7*a* and likewise extends from the jib basic box 7*a* approximately at a right angle backwards. This auxiliary guying support 12*a* is a component of a main jib guying arrangement which comprises an auxiliary guying cable 12*b*. The guying cable 12*b* is guided from a foot of the jib basic box 7*a* by means of the auxiliary guying support 12*a* to the main jib head 7*g*. The auxiliary guying support 12*a* can also be designed as a pair of guying supports disposed in a horizontal plane and in a V shape next to, and with respect to, each other. This additional auxiliary guying arrangement 12*a*, 12*b* serves to brace the main jib 7.

Figure 2A:
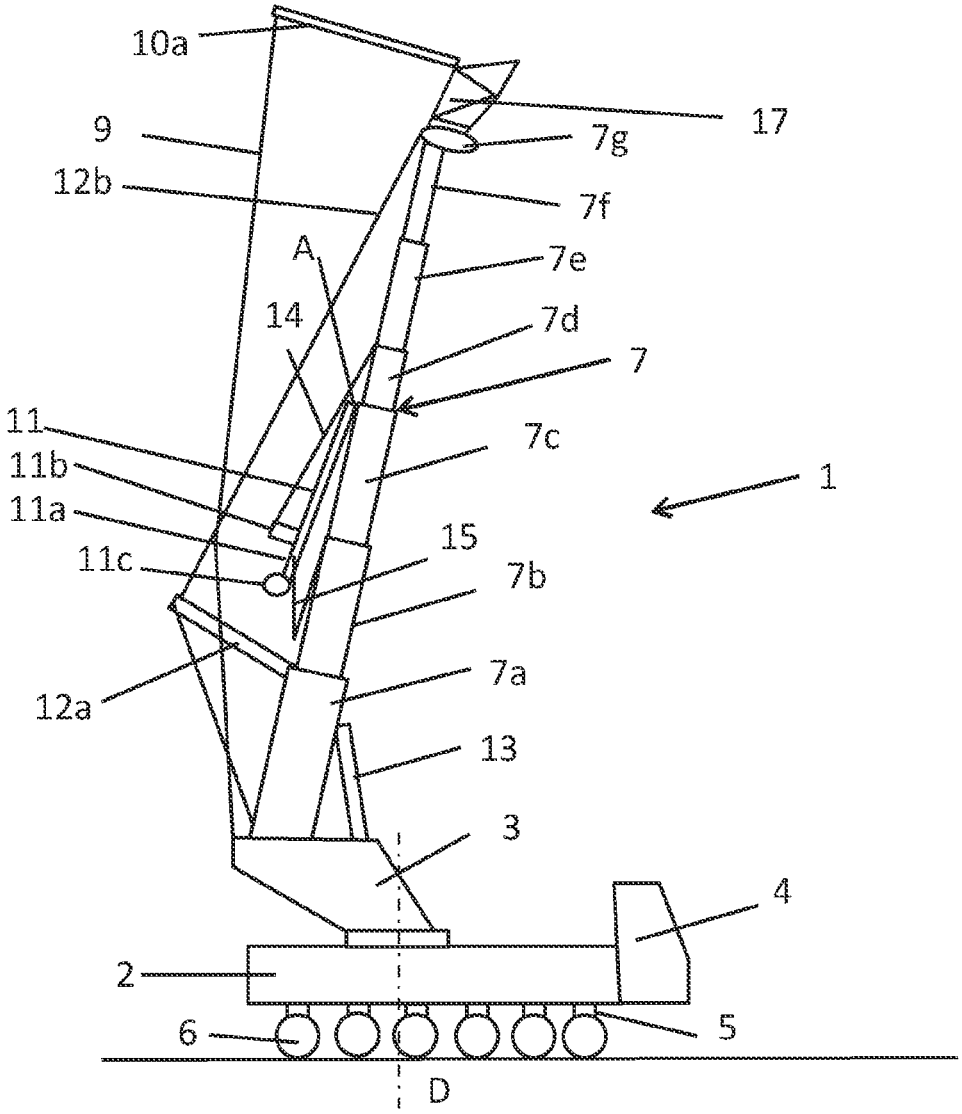
FIG. 2*a* shows a partial view of the vehicle crane according to FIG. 1 from the region of the main jib with a guying support in the inoperative position.
Figure 2B:
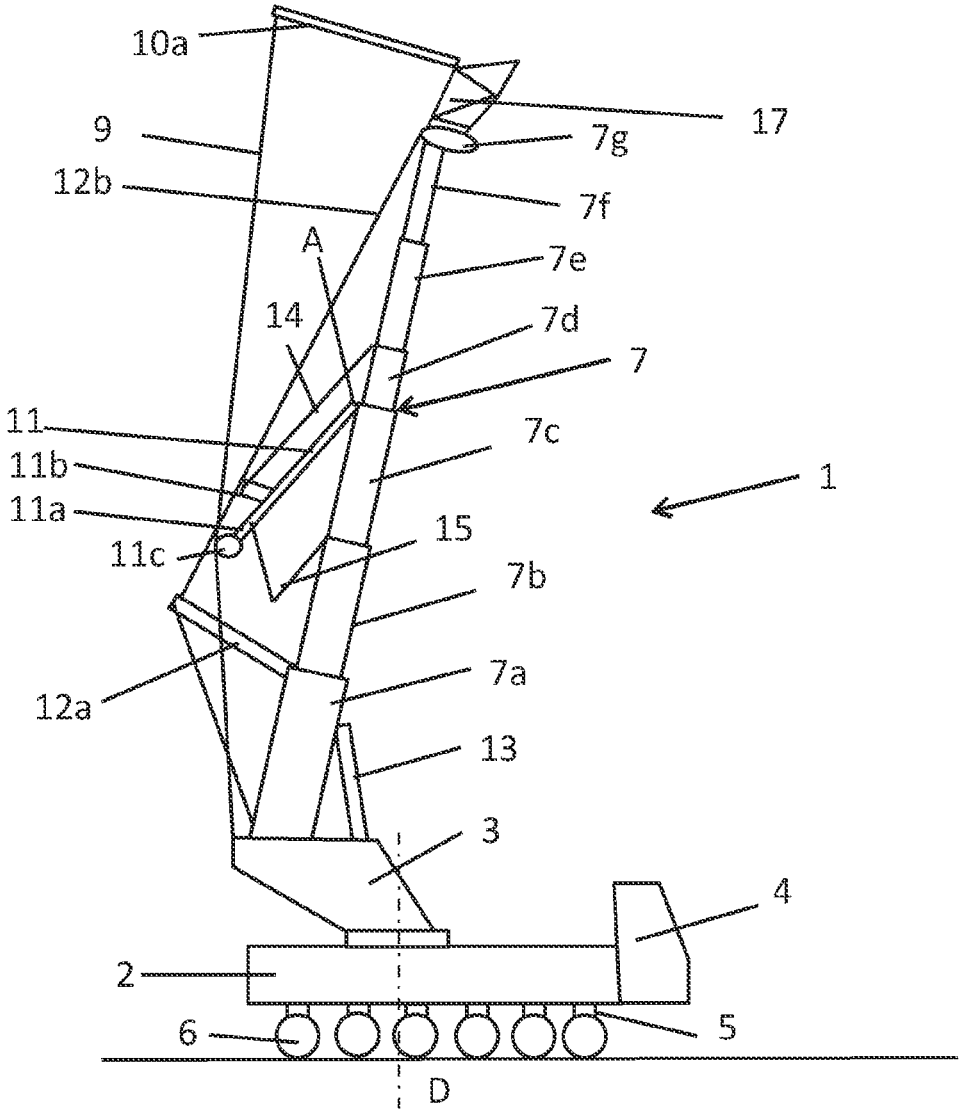
FIG. 2*b* shows a partial view according to FIG. 2*a* with a guying support in an intermediate position.
Figure 2C:
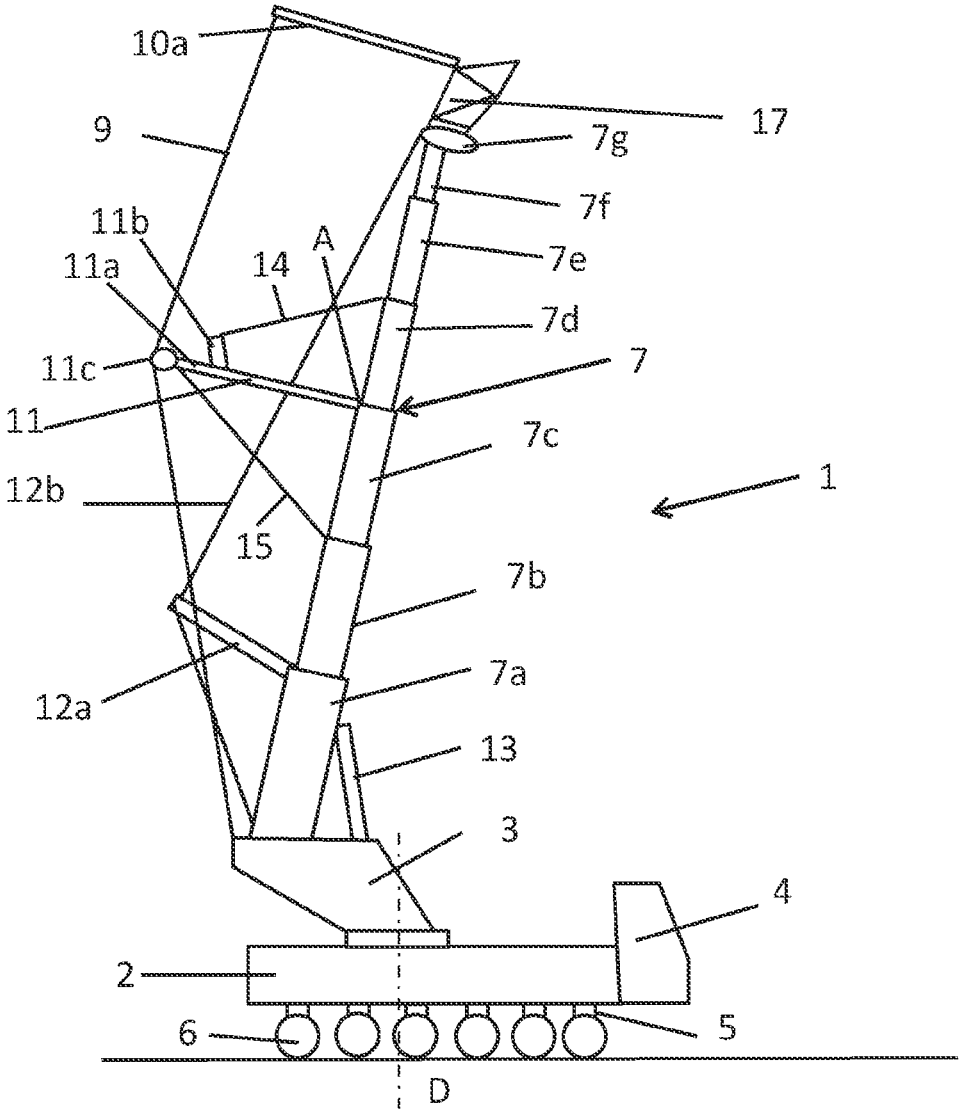
FIG. 2*c* shows a partial view according to FIG. 2*a* with a guying support in an operating position.

FIGS. 2*a* to 2*c* each show a partial view of the main jib 7 of the vehicle crane 1 according to FIG. 1, wherein the guying support 11 is illustrated in each case in one of three positions. The main jib extension 8 has been omitted in order to improve illustration of the guying support 11. Since FIG. 1 is largely identical to FIGS. 2*a* to 2*c*, the following paragraphs will relate only to the differences between the individual figures in the region of the guying support 11.

FIG. 2*a* shows the second guying support 15 in a folded-down inoperative position or transport position almost lying on the main jib 7 and not raised on the main jib 8. The telescoping sections 7*b*, 7*c*, 7*e* and 7*f* are fully or greatly extended and the third telescoping section 7*d* only partially so (about 10%). The third telescoping section 7*d* is telescoped out only far enough for a raising cable 14 to be tensioned, for the guying support 11 to move from the inoperative position lying against the main jib 7 but not yet to move away. The raising cable 14 is fastened at one end to an upper end of the third telescoping section 7*d* and at the other end to the guying support 11 in the region of its free end 11 a at a bracket 11*b*, in particular a front end bracket. In order to be able to introduce raising forces more effectively into the guying support 11, the bracket 11*b* is disposed at a right angle on the guying support 11 and protruding backwards, the raising cable 14 engaging at the free end thereof. Furthermore, FIG. 2*a* shows that the free end 11*a* of the guying support 11 supports a deflection roller 11*c* in a rotatably mounted manner, which deflection roller is in engagement with the luffing cable 9 in the operating position (see FIG. 2*c*). The raising cable 19 can naturally also be fastened to a head of another telescoping section 7*e* or 7*f*.

A safety cable 15 hangs down without tension between the free end 11*a* of the guying support 11, the second guying support 15 and the head of the first telescoping section 7*a*. The safety cable 15 can naturally also be mounted on the head of another telescoping section 7*b* to 7*f*—depending on the installation site of the guying support 11—on the head of the jib basic box 7*a* or on the superstructure 3. The function of the safety cable 15 is to prevent the guying support 11 flipping upwards. In the inoperative position shown in this case, there is no contact between the deflection roller 11*c* and the luffing cable 9. The luffing cable 9 therefore passes from the superstructure 3 to the first luffing support 10 without being deflected.

In FIG. 2*b*, which shows a further partial view of FIG. 1, the guying support 11 is in an intermediate position, i.e. between the inoperative position and an operating position. The telescoping sections 7*b* and 7*f* of the main jib 8 are fully extended, the second telescoping section 7*c* is about 90% extended, the third telescoping section 7*d* is about 20% extended and the fourth telescoping section 7*e* is about 45% extended. The third telescoping section 7*d* is telescoped out further than in FIG. 2*a* so that the raising cable 14 lifts or pulls up the guying support 11 out of its laid-down inoperative position and the deflection roller 11 comes into initial contact with the luffing cable 9 and passes into same. With the guying support 11 in this intermediate position, the safety cable 15 is still not tensioned. In FIG. 2*b* the luffing cable 9 is still not deflected by the deflection roller 11*c*. There is merely initial contact between the luffing cable 9 forming a guying arrangement and the deflection roller 11*c*.

FIG. 2*c* shows a further partial view of FIG. 1 in which the guying support 11 is illustrated in the raised operating position. An angle between the guying support 11 and the second telescoping section 7*c* is between 75 and 90 degrees, preferably 80 degrees, so that under the action of the deflection force from the luffing cable 9 the guying support 11 automatically returns to the inoperative state for transportation even as telescoping section 7*d* is telescoping in. The telescoping sections 7*b* and 7*c* of the main jib 8 are about 90% extended and the telescoping sections 7*d* to 7*f* are about 45% extended. Owing to the fact that the second and third telescoping sections 7*c*, 7*d* are each not fully extended, the tension in the raising cable 14 and the safety cable 15 can be adjusted. The guying support 11 engages the luffing cable 9 with its deflection roller 11*c* and deflects the luffing cable 9 via the deflection roller 11*c*. In this operating position of the guying support 11, the main jib 7 is additionally guyed or stabilised with respect to auxiliary guying arrangement 12*a*, 12*b*. A deformation of the main jib 7 in the load picking-up direction and severe curving of the main jib 7 can hereby be reduced.

In the present exemplified embodiment, the invention is described with the aid of a mobile crane with a telescoping jib. It is obvious that the principle of the present invention can also be applied to lattice mast jibs or folding jibs (foldable jibs of a lattice mast or box design) and also to crawler cranes. Alternatively, the guying support can be brought into the operating position by means of at least one hydraulic raising cylinder. In the case of this alternative, an angle of about 90 degrees between the main jib 7 and guying support 11 would be preferred.

In conjunction with the present exemplified embodiment, it is also feasible that for the case where a vehicle crane 1 comprises a main jib 7 as a telescoping jib with a jib basic box 7*a* and a plurality of telescoping sections 7*b* to 7*f*, the at least one guying support 11 is disposed on the main jib 7 between the jib basic box 7*a* and the innermost telescoping section 7*f*. Preferably, the at least one guying support 11 should be disposed on the main jib 7 in the region of the middle three (in the case where the jib basic box 7*a* and the telescoping sections 7*b* to 7*f* make up an odd number in total), preferably two (in the case where the jib basic box 7*a* and the telescoping sections 7*b* to 7*f* make up an even number in total), particularly preferably of the one middle telescoping section 7*c*, 7*d* (in the case where the jib basic box 7*a* and the telescoping sections 7*b* to 7*f* make up an odd number in total).

If the vehicle crane 1 with a main jib 7 as a telescoping jib is fitted with a jib basic box 7*a* and a plurality of telescoping sections 7*b* to 7*f* and the main jib 7 can be luffed by means of a luffing cylinder 13 articulated on the jib basic box 7*a*, the at least one guying support 11 is thus disposed on the main jib 7 between an articulation of the luffing cylinder 13 on the jib basic box 7*a* and the innermost telescoping section 7*f*.

The invention claimed is:

1. A vehicle crane comprising:

a main jib and a main jib extension mounted thereon and being luffable by at least one luffing cable, wherein the main jib is configured as a telescoping jib with a jib basic box and a plurality of telescoping sections and wherein the main jib is mounted on a superstructure of the vehicle crane in such a manner as to be able to be raised;

wherein the luffing cable, starting from a winch on the vehicle crane, is guided by at least one guying support and at least one luffing support in the region of a main jib head and is fastened at that location; and wherein the winch is disposed in a rear region of the superstructure, the at least one guying support is disposed on the main jib between the jib basic box and the innermost telescoping section and deflects the luffing cable in order to guy the main jib and alternatively the luffing cable is guided by the luffing support further as far as the main jib extension and is fastened at that location.

2. The vehicle crane as claimed in claim 1, wherein the at least one guying support is disposed on the main jib in the region of the middle three, middle two, or the middle one of the telescoping sections.

3. The vehicle crane as claimed in claim 1, wherein a deflection roller is mounted on a free end of the guying support, with the luffing cable being guided over the deflection roller.

4. The vehicle crane as claimed in claim 1, wherein at least a part of the luffing cable is replaced by guying rods, belts, chains or other flexible component with a high level of tensile strength.

5. The vehicle crane as claimed in claim 1, wherein the guying support is disposed so as to be pivotable about a horizontal axis on the main jib and the guying support can be raised from an inoperative position into an operating position.

6. The vehicle crane as claimed in claim 5, wherein the main jib is designed as a telescoping jib and the guying support can be raised by an extension movement of the telescoping jib out of the inoperative position into the operating position.

7. The vehicle crane as claimed in claim 6, wherein the guying support is disposed on a head of the telescoping section of the telescoping jib.

8. The vehicle crane as claimed in claim 6, wherein the guying support can be raised by a raising cable that engages at the end of the guying support by a bracket on the guying support and is connected to a head of a telescoping section above the guying support.

9. The vehicle crane as claimed in claim 6, wherein a safety cable defines maximum raising of the guying support and the safety cable engages at the end of the guying support and is connected to a head of a telescoping section below the guying support.

10. The vehicle crane as claimed in claim 6, wherein a plurality of guying supports are disposed on different heads of telescoping sections of the telescoping jib.

11. The vehicle crane as claimed in claim 6, wherein a safety cable defines maximum raising of the guying support and the safety cable engages at the end of the guying support and is connected to a head of a telescoping section below the guying support.

12. The vehicle crane as claimed in claim 1, wherein the guying support in the operating position forms an angle with respect to the main jib in the range of 75 to 90 degrees.

13. The vehicle crane as claimed in claim 1, wherein the length of the guying support is variably adjustable.

14. A vehicle crane comprising:

a main jib and a main jib extension mounted thereon and being luffable by at least one luffing cable, wherein the main jib is configured as a telescoping jib with a jib basic box and a plurality of telescoping sections and wherein the main jib is mounted on a superstructure of the vehicle crane in such a manner as to be able to be raised;

wherein the luffing cable, starting from a winch on the vehicle crane, is guided by at least one guying support and at least one luffing support in the region of a main jib head and is fastened at that location;

wherein the winch is disposed in a rear region of the superstructure, the at least one guying support is disposed on the main jib between the jib basic box and the innermost telescoping section and deflects the luffing cable in order to guy the main jib and alternatively the luffing cable is guided by the luffing support further as far as the main jib extension and is fastened at that location; and wherein the at least one guying support is disposed on the main jib in the region of a middle one of the telescoping sections.

15. The vehicle crane as claimed in claim 14, wherein a deflection roller is mounted on a free end of the guying support, with the luffing cable being guided over the deflection roller.

16. The vehicle crane as claimed in claim 14, wherein the guying support is disposed so as to be pivotable about a horizontal axis on the main jib and the guying support can be raised from an inoperative position into an operating position.

17. The vehicle crane as claimed in claim 14, wherein the guying support in the operating position forms an angle with respect to the main jib in the range of 75 to 90 degrees.

18. The vehicle crane as claimed in claim 17, wherein the main jib is designed as a telescoping jib and the guying support can be raised by an extension movement of the telescoping jib out of the inoperative position into the operating position.

19. The vehicle crane as claimed in claim 17, wherein the at least one guying support is disposed on a head of the telescoping section of the telescoping jib, or wherein the at least one guying support comprises a plurality of guying supports and wherein the plurality of guying supports are disposed on different heads of telescoping sections of the telescoping jib.

20. The vehicle crane as claimed in claim 17, wherein the guying support can be raised by a raising cable that engages at the end of the guying support by a bracket on the guying support and is connected to a head of a telescoping section above the guying support.

* * * * *